US006202336B1

(12) United States Patent
Audino

(10) Patent No.: US 6,202,336 B1
(45) Date of Patent: Mar. 20, 2001

(54) SAFETY DEVICE FOR FIREARMS

(76) Inventor: Allan E. Audino, 9 Apple Blossom Dr., Johnston, RI (US) 02919

( * ) Notice: Subject to any disclaimer, the term of this patent is extended or adjusted under 35 U.S.C. 154(b) by 0 days.

(21) Appl. No.: 09/317,930

(22) Filed: May 24, 1999

(51) Int. Cl.[7] ..... F41A 17/00
(52) U.S. Cl. ..... 42/70.11
(58) Field of Search ..... 42/70.11

(56) References Cited

U.S. PATENT DOCUMENTS

| | | | | |
|---|---|---|---|---|
| 2,836,918 | * | 6/1958 | Pula et al. | 42/1 |
| 4,398,366 | * | 8/1983 | Wernicki | 42/70.11 |
| 4,827,649 | * | 5/1989 | Sheehan | 42/70.11 |
| 5,052,142 | * | 10/1991 | Mikus | 42/70.11 |
| 5,398,438 | * | 3/1995 | Williams | 42/70.11 |
| 5,664,358 | * | 9/1997 | Haber et al. | 42/70.11 |
| 5,860,241 | * | 1/1999 | Waters | 42/70.11 |

* cited by examiner

*Primary Examiner*—Michael J. Carone
*Assistant Examiner*—Denise J Buckley
(74) *Attorney, Agent, or Firm*—Salter & Michaelson

(57) ABSTRACT

A safety device including a locking member which is inserted and locked within the barrel and firing chamber of a firearm to prevent firing of the same is provided. The locking member preferably includes a rod having a leading or first end which is at least partially insertable within the firing chamber of the weapon, and an outer sleeve including a trailing or second end which is expandable in a first direction to produce a tight frictional engagement between the sleeve and the inner wall of the barrel in order to secure the locking member within the firearm. The rod is at least partially insertable within a cavity in a first end of the sleeve such that the overall length of the locking member is adjustable to fit different weapons, for example a revolver and an automatic pistol. The second end of the sleeve preferably includes a pair of slots dividing the sleeve into first and second sections which expand in the first direction within the barrel of the firearm upon insertion of an expansion member, such as a wedge or threaded screw, into an opening in the second end of the sleeve. A compression spring is also preferably provided, the spring being disposed within the cavity of the sleeve, between the rod and the sleeve, such that the spring biases the rod longitudinally, i.e., outwardly and away from the sleeve in an uncompressed state. The spring allows the overall length of the locking member to be adjusted within the firearm, particularly for extending the length of the locking member into the firing chamber of an automatic pistol upon removal of the magazine. A locking key is also provided for inserting the expansion member into the second end of the sleeve in order to expand the same. In one embodiment, the key is part of a key assembly which includes an engagement member for holding the outer surface of the sleeve to prevent rotation. The engagement member may also be utilized to remove the locking member from within the firearm.

20 Claims, 8 Drawing Sheets

SAFETY DEVICE FOR FIREARMS

DESCRIPTION

1. Technical Field

The invention relates generally to a safety device for temporarily disabling a firearm, and more particularly to a safety device which can be utilized with both a revolver and an automatic pistol to disable loading and firing of the same.

2. Background of Related Art

Many people in today's society own firearms, such as handguns and rifles, and keep the firearms in their home. As the popularity of firearms has increased, so too has the number of injuries due to the use of such firearms. In many cases such injuries are caused by the accidental discharge of the firearm by a person not trained to operate the weapon, such as by a child. The need for devices to temporarily lock or secure the firearm so that they become inoperable to unauthorized persons has become an issue of increased importance in view of the number of accidental shootings each year. Numerous devices have been proposed in an attempt to prevent such accidents.

One such device is a firearm safe into which various types of firearms may be placed and locked. Although firearm safes can prevent access to the firearm by an unauthorized person, such devices may also prevent immediate access to the firearm by the firearm owner. For example, if there is a sudden need to obtain the firearm such as during a burglary, it may not be possible to reach the firearm safe in time to access the firearm. Other safety devices have been proposed which temporarily disable firing of the firearm. Such devices include trigger locks and gun locks which prevent firing of the firearm in any number of different ways. Trigger locks prevent access to the trigger to prevent firing of the firearm, but do not prevent loading of the weapon. Gun locks, on the other hand, may prevent both firing and loading of the weapon. Gun locks take many forms, one form being a rod-shaped lock which is inserted into the barrel and/or firing chamber of the firearm. Examples of such gun locking devices may be found in U.S. Pat. No. 2,478,098 to Hansen, U.S. Pat. No. 3,154,874 to Stewart, U.S. Pat. No. 3,360,880 to Finnegan, U.S. Pat. No. 5,048,211 to Hepp, U.S. Pat. No. 5,138,785 to Paterson, and U.S. Pat. No. 5,171,924 to Honey et al., to name a few.

Although a number of attempts have been made to design effective locking devices for firearms, such as the devices described in the aforementioned patents, previous devices have not always met with success. To be successful a firearm locking device should prevent the firearm from being both loaded and fired, be easy for the gun owner to operate while difficult for an unauthorized person to disable, and should not damage the firearm. The device should also preferably be designed for use with various style and/or size guns. The safety device should also be inexpensive to produce and preferably provide an indication if the firearm still has a bullet disposed therein.

Accordingly, it is an object of the present invention to provide a firearm safety device which is inexpensive to manufacture, easy for the gun owner to operate, difficult for an unauthorized person (such as a child) to disable, which can be designed for use with various size and style guns, and which provides an indication if the firearm still has a bullet disposed in it.

SUMMARY

In accordance with the present invention, there is provided a safety device for temporarily disabling a firearm.

The safety device includes a locking member which is inserted and locked within the barrel and firing chamber of a firearm to prevent firing of the same. The locking member preferably includes a rod having a leading or first end which is at least partially insertable within the firing chamber of the weapon, and an expandable outer sleeve including a trailing or second end which is expandable in a first, transverse direction. Expansion of the outer sleeve produces a tight frictional engagement between the sleeve and an inner wall of the barrel in order to secure the locking member within the firearm. The rod is at least partially insertable within a first end of the sleeve such that the overall length of the locking member is adjustable to fit different weapons, for example a revolver and an automatic pistol. In one embodiment, the first end of the expandable sleeve has a cavity for receiving the rod therein, and the second end is substantially solid having a pair of elongated slots extending along a length thereof. The slots allow the second end of the sleeve to expand in the first direction within the barrel of the firearm upon insertion of an expansion member, such as a wedge or threaded screw, into an opening in the second end of the sleeve. A compression spring is also preferably provided, the spring being disposed within the cavity of the sleeve, between the rod and the sleeve, such that the spring biases the rod outwardly and away from the sleeve in an uncompressed state. The spring may be utilized to extend the locking member into the firing chamber of an automatic pistol upon removal of the magazine, as described in further detail herein below.

A locking key is also preferably provided for inserting the wedge or threaded screw member into the second end of the sleeve in order to expand the same. In one embodiment, the key is part of a key assembly which includes an engagement member for holding the outer surface of the sleeve to prevent rotation, and a locking key for engaging and inserting the wedge or threaded screw member into the second end of the sleeve.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE ILLUSTRATIVE EMBODIMENTS

Figure 1:
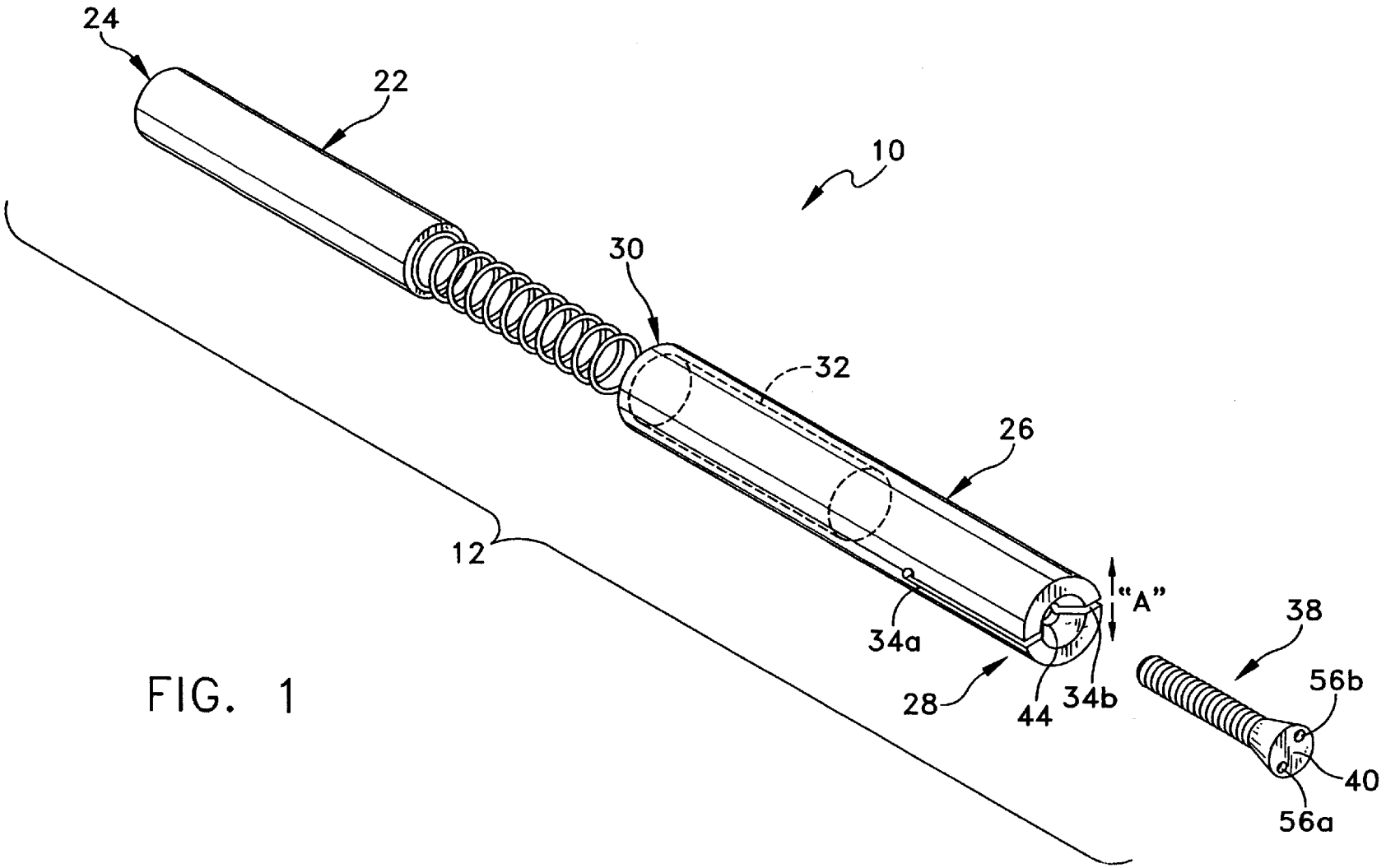
FIG. 1 is a perspective view of a safety device for temporarily disabling a firearm according to the present invention.
Figure 2:
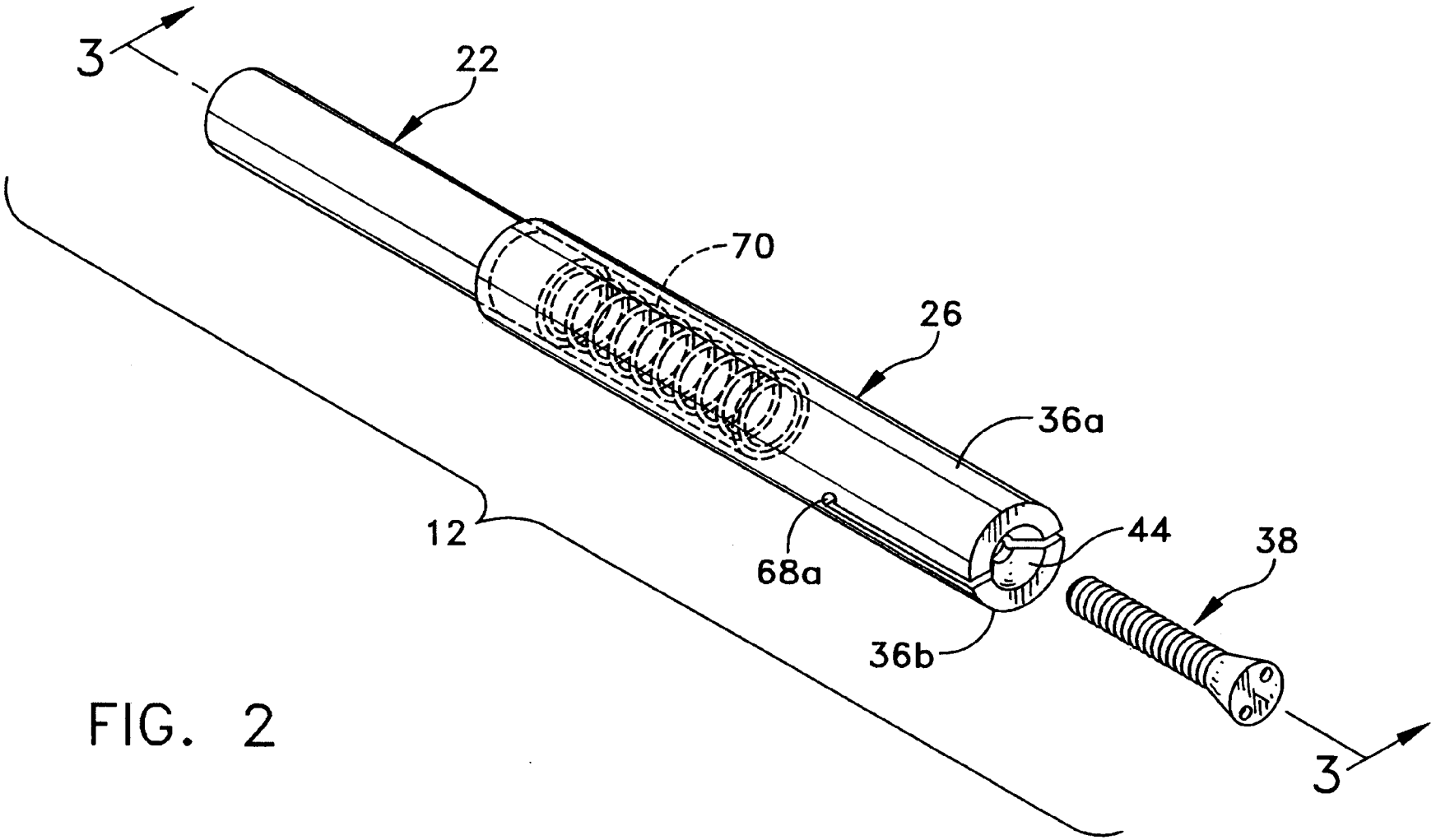
FIG. 2 is a perspective view of the safety device of FIG. 1 with the inner rod partially inserted within the outer, expandable sleeve.
Figure 3:
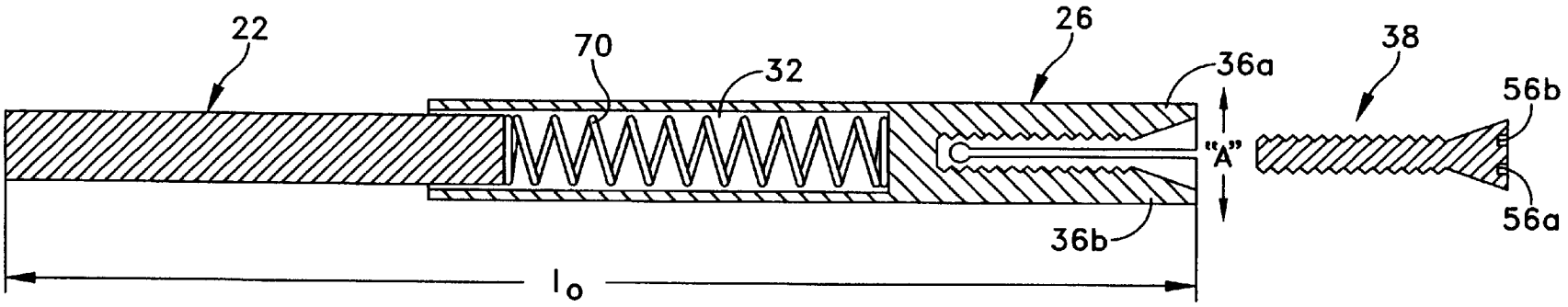
FIG. 3 is a cross-sectional view of the safety device of FIG. 2, taken along lines 3—3.
Figure 4:
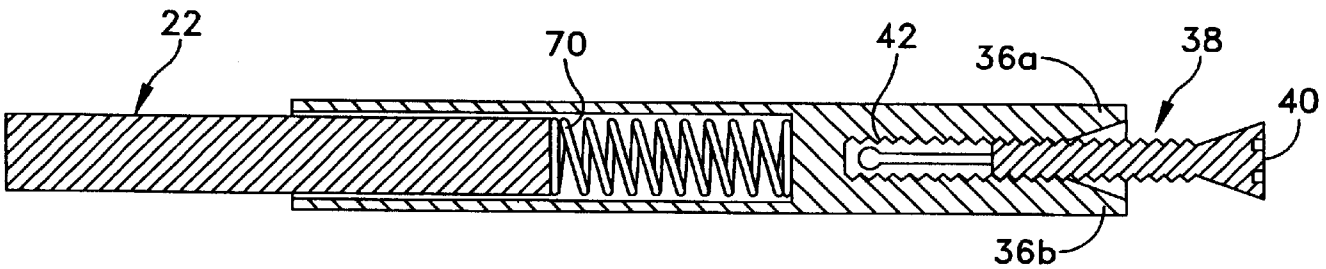
FIG. 4 is a cross sectional, side view of the device of FIG. 1 showing the inner rod inserted within the first end of the outer sleeve to compress the spring and the expansion screw partially inserted within the second of the outer sleeve.

A safety device 10 including a locking member 12 which is insertable within a barrel 14 and firing chamber 16 of a firearm 18 for temporarily disabling the firearm is illustrated in FIGS. 1–10. The locking member 12 is expandable in a first direction so as to frictionally engage the inner wall 20 of the barrel in order to tightly secure the locking member within the barrel and firing chamber to prevent firing of the weapon. The locking member preferably includes an inner rod 22 having a leading or first end 24 which is at least partially insertable within the firing chamber of the weapon, and an expandable outer sleeve 26 including a trailing or second end 28 which is expandable in the first, transverse direction ("A") to produce a tight frictional engagement between the sleeve and the inner wall of the barrel in order to secure the locking member within the firearm. The locking member is sized according to the caliper of the gun with which it is to be used. Therefore, the diameter of the locking member at its widest point should be slightly smaller than the caliper of the weapon for which it is to be used in order for the locking member to properly fit within the barrel of the firearm without having to be forced into the barrel, which could cause damage to the weapon. Likewise, the length of the locking member should be sufficient to allow the locking member to extend at least partially into both the firing chamber and barrel of the firearm. The locking member may preferably be fully inserted into the barrel and firing chamber such that it does not extend outside of the firearm so that an unauthorized person is less likely to be able to disable the locking member. The locking member is also preferably made of a non-marring material, or may have a mar resistant coating, so that the locking member will not scratch or otherwise mar the firearm. Such non-marring materials and mar resistant coatings are well known to those of skill in the art.

The inner rod 22 of the locking member is at least partially insertable within a first end 30 of the expandable sleeve such that the overall length, "$l_o$" of the locking member is adjustable to fit different weapons, for example a revolver and an automatic pistol. In the present embodiment, the first end of the expandable sleeve has a cavity 32 for receiving the rod therein. The rod may be solid or hollow and may have varying lengths, but the outer diameter should be smaller than the diameter of the cavity of the sleeve so that the rod fits within sleeve. The second end 28 of the outer sleeve may preferably be substantially solid and includes a pair of elongated slots 34*a, b* disposed through the sleeve on opposite sides thereof. The elongated slots extend along a portion of the length of the sleeve to divide the second end of the sleeve into first and second sections 36*a, b*. The sections 346, *b* expand in the first direction within the barrel of the firearm upon insertion of an expansion member 38 (such as a wedge or threaded screw member) into an opening 44 in the second end, as described below. In the present embodiment, the expansion member 38 is a threaded screw member received within a corresponding threaded bore 42 disposed in the second end 28 of the sleeve and including a tapered or wedge-like head portion 40 which is received within a corresponding tapered opening 44. Inserting the threaded end of the screw into the corresponding threaded bore and turning the screw until the head portion 40 enters the tapered opening forces the first and second sections 36*a, b* of the second end of the sleeve apart until the sleeve frictionally engages the inner surface of the barrel to secure the locking member therein.

Figure 5:
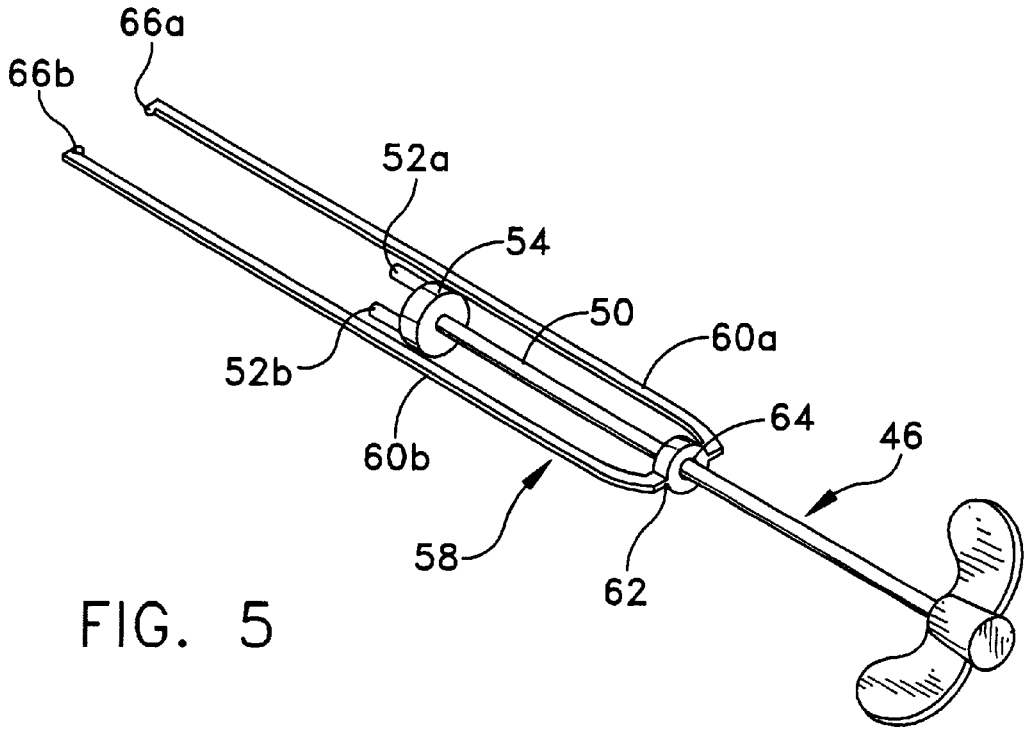
FIG. 5 is a perspective view of a locking key assembly for use with the safety device of FIG. 1.
Figure 6:
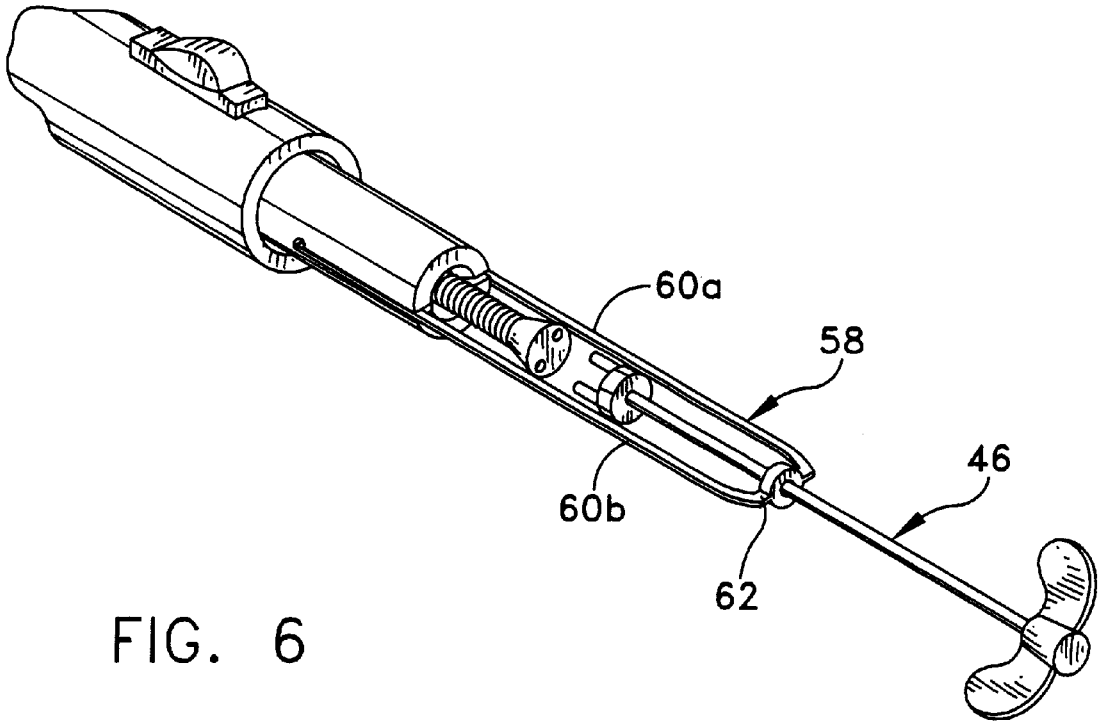
FIG. 6 is a perspective view of the locking key in use with the safety device of FIG. 1.
Figure 7:
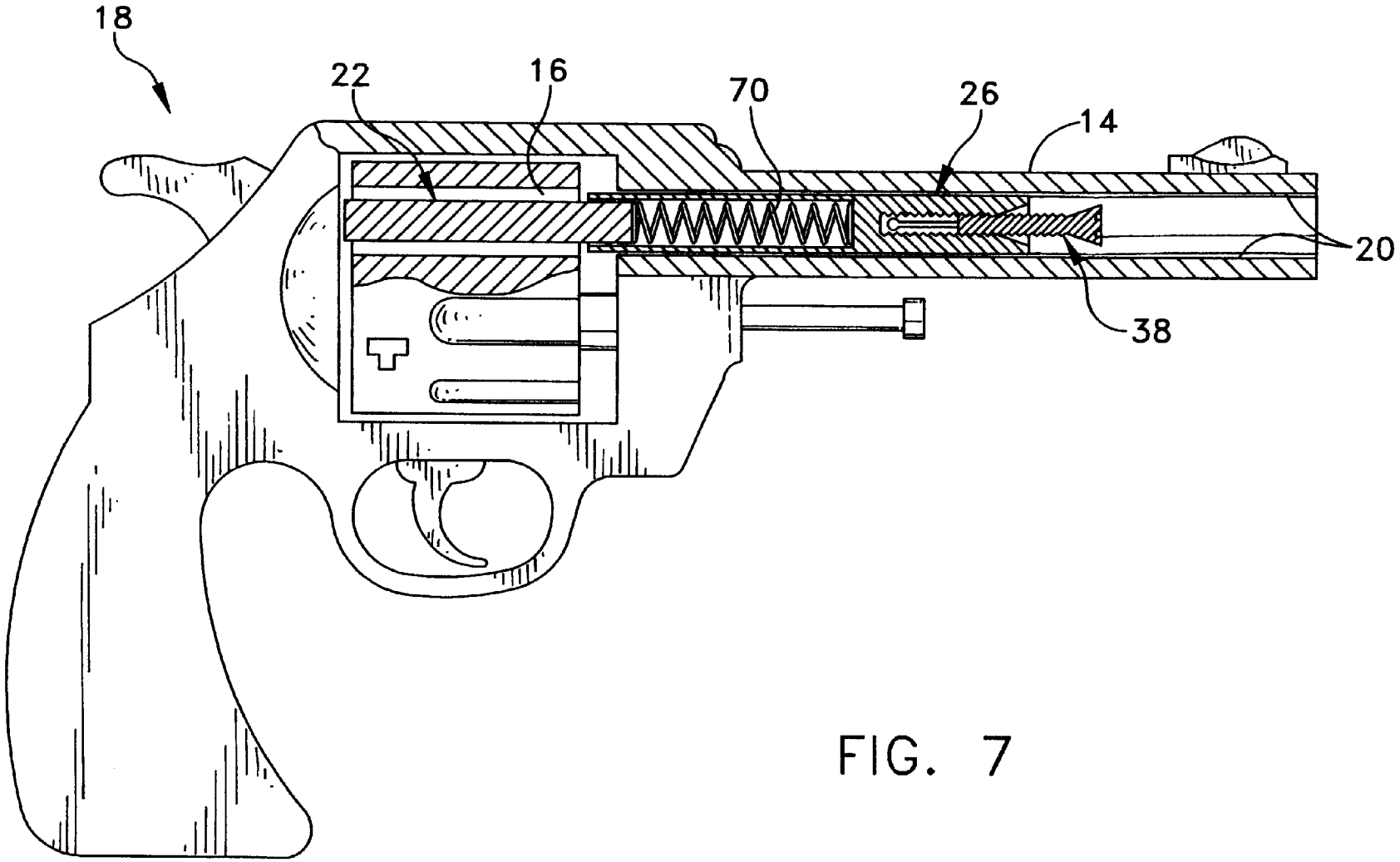
FIG. 7 is a cross-sectional side view of the safety device of FIG. 1 in an unlocked position within an unloaded revolver.

A locking key 46 is preferably provided for engaging the head portion 40 of the expansion member 38 and for inserting the same into the opening in the second end of the sleeve in order to expand the sleeve. In the present embodiment, the locking key includes a handle 48 for turning the key, a shaft 50 extending from the handle, and a pair of pins 52*a, b* extending from a base 54 of the key. The pins are insertable into corresponding apertures 56*a, b* formed in the head portion of the expansion member in order to turn the same. Other style keys and apertures may readily be utilized as would be known to one of skill in the art, although the key is preferably specially keyed so that only the locking key will work with the expansion member and not a screwdriver or other device. The locking key 46 may preferably be formed as part of a key assembly including an engagement member 58 for holding the outer surface of the sleeve to prevent rotation of the sleeve as the expansion member is inserted into the second end of the sleeve. As shown in FIGS. 5–6, the engagement member 58 may include a first and a second leg 60*a, b* connected by a bridge 62 which includes a hole 64 disposed therein for receipt of the shaft of the key therethrough. The legs 60*a, b* are preferably sized to fit within elongated slots 34*a, b* and may each include a protrusion 66*a, b* extending from a first end thereof for insertion into a corresponding portion 68*a, b* of the slots in order to allow the engagement member to firmly grip the sleeve to prevent rotation thereof. The engagement member 58 may also be utilized when unlocking the device, and can be used to remove the locking member from within the firearm, as described below.

Referring now to FIGS. 1–4, a compression spring 70 may also preferably be provided within the cavity 32 of the sleeve, between the rod and the sleeve, such that the spring biases the rod outwardly and away from the sleeve in an uncompressed state. The spring 70 allows the overall length of the locking member to be adjusted before or after insertion into the weapon. For example, the overall length of the locking member may be decreased by pushing the sleeve against the biasing force of the spring and then expanding the sleeve to lock the device in place within the weapon. This is advantageous as it allows the locking member to adjust to firearms having barrels of various lengths after insertion into the firearm. The spring may also extend the overall length of the locking member, for example by extending the locking member into the firing chamber of an automatic pistol upon removal of the magazine, as described in further detail herein below. Use of the safety device for temporarily disabling a firearm will now be described with reference to the figures.

In use, the firearm is first unloaded by a user such that no bullets should remain in the weapon. Unloading of the weapon should be performed in accordance with the manufacturer's instructions for the particular weapon. Once unloaded, the user selects an appropriately sized locking member according to the caliper of the weapon. The user then inserts the locking member, including the rod, compression spring and expandable sleeve (as described above), into the barrel and firing chamber of the firearm. In a conventional revolver having a revolving, bullet-receiving cylinder containing a plurality of separate chambers (FIGS. 7–8), the locking member should be of sufficient length to be inserted within the barrel 14 and into the empty firing chamber 16 aligned with the barrel of the gun. If there are any bullets in either the firing chamber or the barrel, the locking member will not properly extend into both the chamber and the barrel such that the device will not lock the firearm. Upon trying to insert the locking member and discovering the presence of a bullet, the user would remove the locking member and bullet and then re-insert the locking member.

Figure 9:
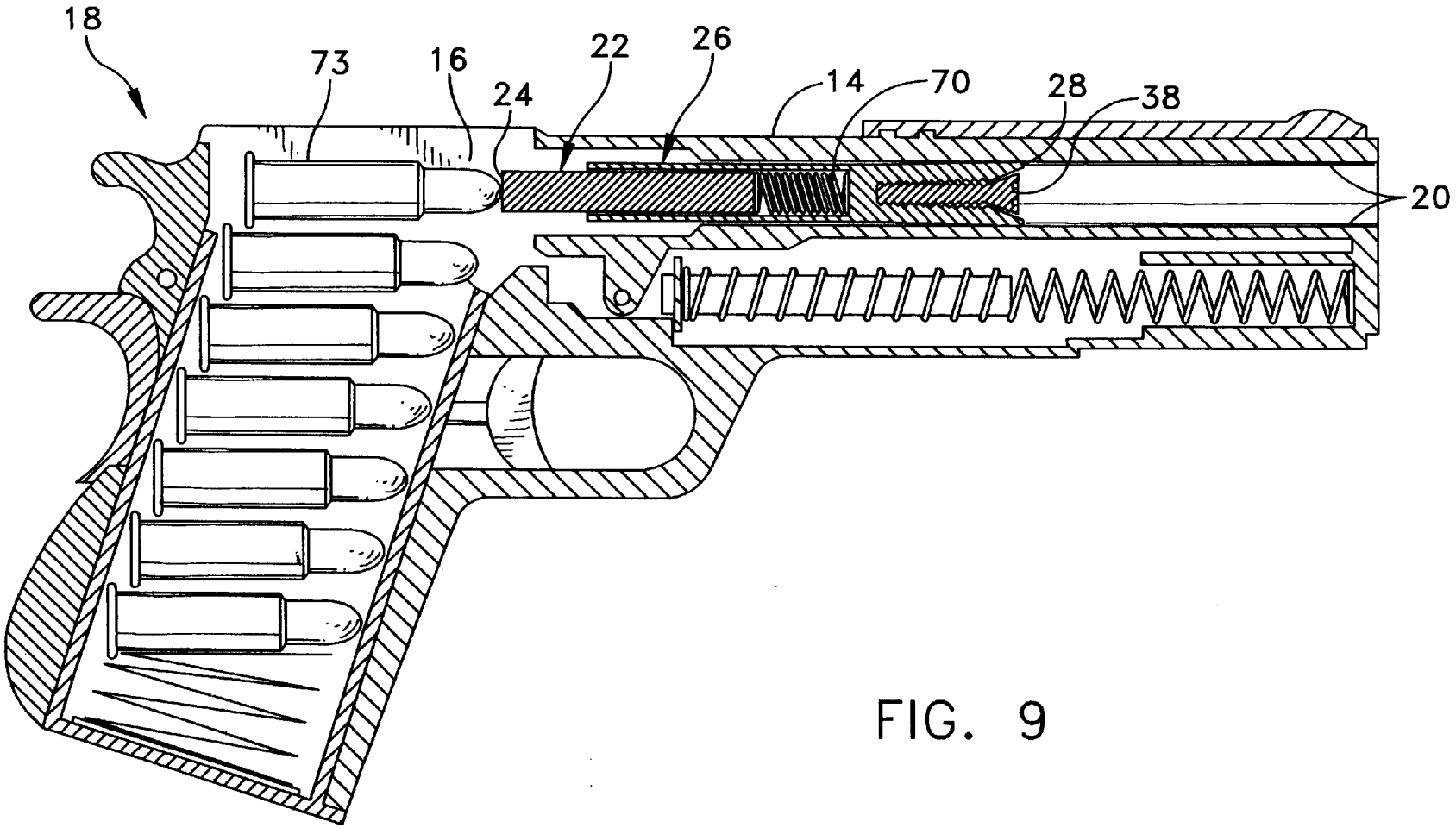
FIG. 9 is a cross-sectional side view of the safety device of FIG. 1 in a locked position within a loaded automatic pistol having a bullet disposed in the firing chamber.
Figure 10:
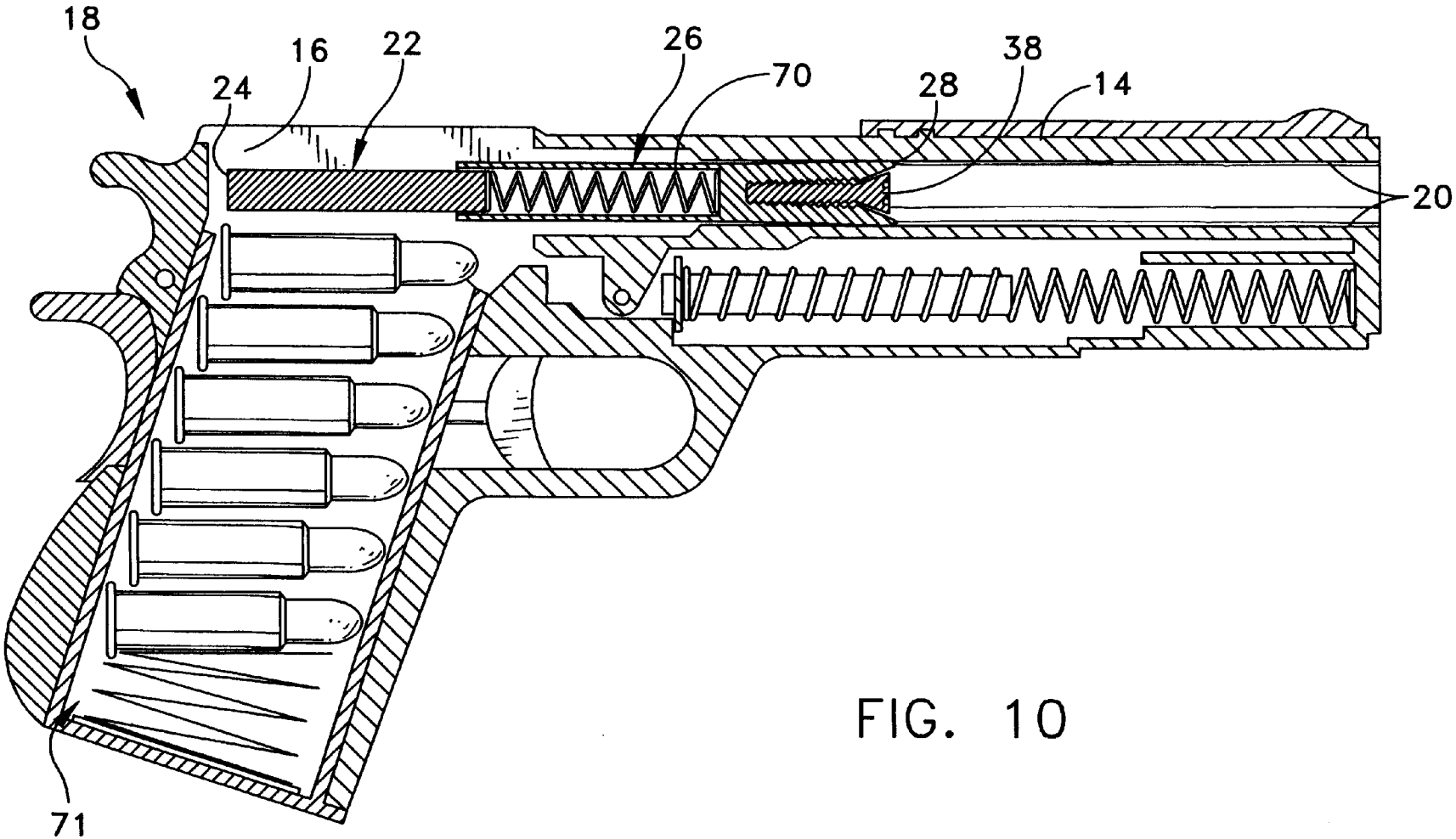
FIG. 10 is a cross-sectional side view of the safety device of FIG. 9 in a locked position within the automatic pistol after removal of the bullet from the firing chamber.

In a conventional automatic pistol having a magazine for automatically loading bullets into the firing chamber (FIGS. 9–10), the locking member is likewise inserted into both the barrel and chamber of weapon. However, with an automatic, the locking member may be inserted into the barrel of the pistol while the pistol is loaded, i.e. when a magazine 71 is in place and a bullet 73 is in the firing chamber, the inner rod of the locking member being spring biased into the firing chamber upon removal of the bullet from the firing chamber. For example, the locking member may be inserted into the barrel of the automatic as shown in FIG. 9, with the rod being compressed against the force of the biasing spring by bullet 73 disposed in the firing chamber. The locking member is then secured within the weapon by inserting the expansion member into the second end of the sleeve in order to expand the same such that a tight frictional engagement is formed between the sleeve and the inner surface of the barrel, as described above. Upon removal of the magazine and bullet from within the firing chamber, the compression spring will bias the rod in the direction of arrow "B" in order to move the same into the empty firing chamber as shown in FIG. 10. If a magazine is now inserted into the weapon, the bullets will be prevented from entering the firing chamber by the extended rod, thus preventing loading of the weapon.

Figure 8:
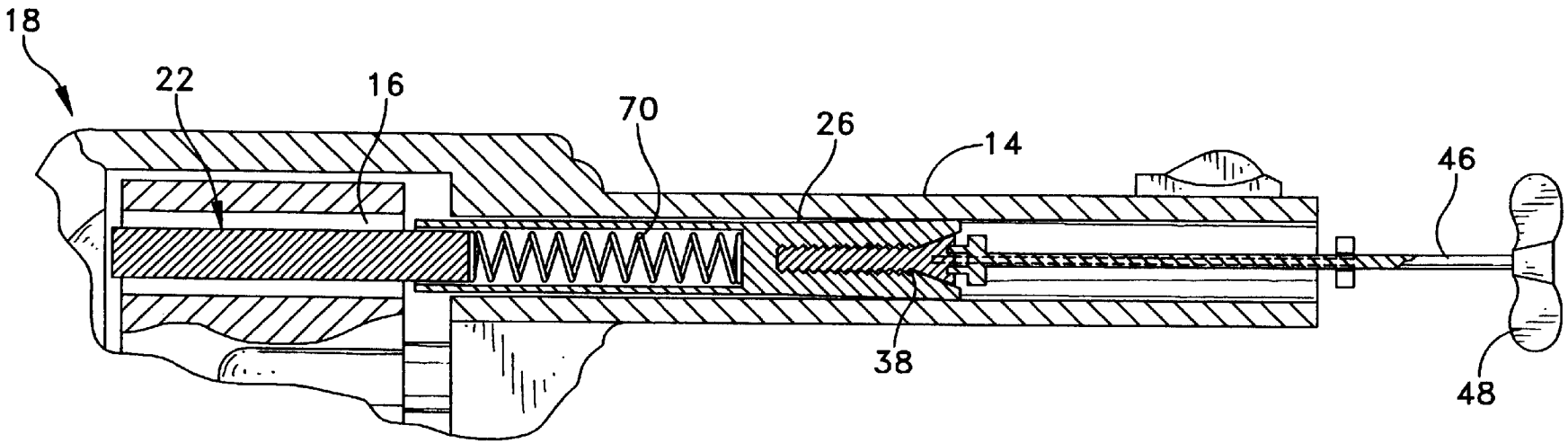
FIG. 8 is a partial cross-sectional side view of the safety device of FIG. 1 in a locked position within an unloaded revolver.

In either a revolver or an automatic pistol, the locking member is secured within the weapon by inserting and securing the expansion member into the opening in the second end with the key assembly. As shown in FIGS. 6 and 8, the first and second legs of the engagement member are inserted within the elongated slots of the sleeve (either before or after insertion into the barrel of the weapon) in order to firmly grip the sleeve and prevent rotation thereof. The elongated key is then inserted into the barrel of the firearm until the specially keyed portion, i.e. prongs in the present embodiment, engage the corresponding openings in the expansion member. The user then grasps the handle of the key and turns the same (for example in a clockwise direction) in order to mate the threaded portion of the expansion member with the threaded bore of the sleeve. Upon continued turning of the key the wedge-shaped head portion of the expansion member is received within the corresponding tapered opening of the sleeve. Inserting the threaded end of the screw into the corresponding threaded bore and turning the screw until the head portion enters the tapered opening forces the first and second sections of the second end of the sleeve apart until the sleeve frictionally engages the inner surface of the barrel to secure the locking member therein. Once secured within the firearm, the locking member temporarily disables the firearm, preventing both firing and loading of the weapon.

In order to remove the locking member, the user may re-insert the first and second legs of the engagement member within the corresponding slots in the sleeve, although only the key need be inserted to unlock the device. The user then inserts the prongs of the key into the corresponding openings in the expansion member and turns the key in an opposite direction (for example counter clock wise) in order to remove the head portion from within the tapered opening. Once the head portion is removed from within the tapered opening, the force applied to the second end of the sleeve by the expansion member is relieved, thus allowing the first and second sections of the sleeve to return to their initial, unexpanded configuration. The locking member may now be readily removed from the firearm. The user can grasp the engagement member in order to remove the locking member from within the firearm or the user can simply tip the weapon so that the locking member slides out from within the firearm.

It will be understood that various modifications may be made to the embodiment disclosed herein. For example, the device may be made from a variety of materials and in varying dimensions, depending upon the style and caliper of the firearm. In addition, the device may find use in other style firearms other than revolvers and automatic pistols as described above. Also, the outer sleeve may be expandable in alternate ways, other than by the provisions of slots and an expanding member. Finally, the key utilized to lock the device may take other forms other than having a pair of pins. Therefore, the above description should not be construed as limiting, but merely as exemplifications of a preferred embodiment. Those skilled in the art will envision other modifications within the scope spirit of the invention.

What is claimed is:

1. A safety device for temporarily disabling a firearm comprising:

a locking member configured and dimensioned to be inserted within both a barrel and firing chamber of the firearm, the locking member having an adjustable length and including:

a) an outer sleeve configured and dimensioned to be at least partially insertable within the barrel of the firearm and including a first end having a cavity formed therein and a second end expandable in a first direction and including an opening accessible through the barrel of the firearm;

b) an inner rod having a first end configured and dimensioned to be at least partially insertable within the firing chamber and a second end configured and dimensioned to be at least partially insertable within the cavity of the outer sleeve;

c) a spring configured and dimensioned to be at least partially insertable within the cavity of the outer sleeve, between the second end of the inner rod and the outer sleeve so as to bias the inner rod in an outward direction;

d) an expansion member configured and dimensioned to be received within the opening in the second end of the sleeve, wherein insertion of the expansion member within the opening in the sleeve expands the second end of the sleeve in a first direction until the sleeve frictionally engages an inner surface of the barrel so as to secure the locking member therein such that the firearm cannot be loaded or fired; and wherein the overall length of the locking member can be adjusted by moving the rod and sleeve relative to each other against the biasing force of the spring such that the overall length of the locking member can be adjusted and locked at different lengths so as to fit into the barrel and firing chamber of different type firearms, and wherein the safety device does not extend from within the firearm so as to be resistant to tampering.

2. The safety device of claim 1, wherein the locking member further comprises at least a pair of longitudinally extending slots disposed in the second end of the outer sleeve, the slots dividing the second end of the sleeve into a first section and a second section, the first and second sections being expandable in the first direction transverse to the longitudinally extending slots upon insertion of the expansion member into the opening in the second end of the sleeve.

3. The safety device of claim 2, further comprising a locking key including a handle portion, a shaft extending from the handle, and a base including a specially keyed member configured and arranged to be inserted into a corresponding aperture in the expansion member in order to turn the same.

4. The safety device of claim 3, wherein the specially keyed member includes at least one pin insertable into the corresponding aperture formed in a head portion of the expansion member.

5. The safety device of claim 3, further comprising an engagement member configured and arranged to engage the sleeve so as to grip the sleeve and prevent rotation thereof as the expansion member is inserted into the opening in the second end of the sleeve.

6. The safety device of claim 5, wherein the engagement member includes a first leg and a second leg configured and dimensioned to fit within the first and second elongated slots, the first and second legs being connected by a bridge having an opening disposed therein for receipt of the shaft of the key therethrough.

7. The safety device of claim 1, wherein the expansion member includes a wedge-shaped head portion and wherein the opening in the second end of the sleeve is tapered for receipt of the wedge-shaped head portion.

8. The safety device of claim 7, wherein the expansion member is a screw including a threaded portion and wherein the second end of the sleeve further includes a threaded bore disposed therein.

9. The safety device of claim 1, in combination with a revolver having a revolving, bullet-receiving cylinder containing a plurality of separate chambers, the locking member being insertable within a chamber aligned with the barrel of the gun.

10. The safety device of claim 1, in combination with an automatic pistol having a magazine for automatically loading bullets into the firing chamber, the locking member being insertable into the pistol when a bullet is in the firing chamber such that the inner rod contacts the bullet, the inner rod of the locking member being biased by the spring into the firing chamber upon removal of the bullet from the firing chamber.

11. A method for temporarily disabling a firearm comprising:

inserting a locking member including an outer sleeve having a first end with a cavity formed therein, a second end expandable in a first direction, and an opening in the second end; an inner rod having a second end at least partially disposed within the cavity of the outer sleeve, and a compression spring disposed within the cavity of the outer sleeve between the second end of the inner rod and the outer sleeve into the barrel of a firearm such that the locking member is fully disposed within the firearm;

adjusting the overall length of the locking member by moving the rod and sleeve relative to each other such that the locking member can extend into both the barrel and firing chamber of different types of firearms and be locked therein, and securing the locking member within the firearm by inserting an expansion member into the barrel and within the opening in the second end of the sleeve, the opening in the second end of the sleeve being accessible through the barrel, so as to expand the second end of the sleeve in a first direction until the sleeve frictionally engages an inner surface of the barrel to secure the locking member therein such that the firearm cannot be loaded or fired.

12. The method of claim 11, further comprising the step of inserting a keyed member into a corresponding aperture in the expansion member in order to turn the same.

13. The method of claim 12, further comprising the step of gripping the sleeve with an engagement member to prevent rotation of the sleeve as the expansion member is inserted into the opening in the second end of the sleeve.

14. The method of claim 11, further comprising the step of inserting the locking member into the barrel of an automatic pistol when a bullet is in the firing chamber such that the inner rod contacts one end of the bullet and is biased against the force of the compression spring.

15. The method of claim 14, further comprising the step of removing the bullet from within the firing chamber, wherein the inner rod of the locking member is biased by the spring into the firing chamber upon removal of the bullet from the firing chamber.

16. The method of claim 11, further comprising the step of inserting a first end of the rod into a firing chamber of the firearm.

17. The method of claim 11, further comprising the step removing the expansion member from within the second end of the sleeve, thus allowing the second end of the sleeve to return to an unexpanded configuration for removal of the locking member from the firearm.

18. A safety device for temporarily disabling a firearm comprising:

a locking member configured and dimensioned to be inserted within both a barrel and firing chamber of the firearm, the locking member having an adjustable length and including:

a) an outer sleeve configured and dimensioned to be at least partially insertable within the barrel of the firearm and including a first end having a cavity formed therein, and a second end including a tapered opening therein accessible through the barrel of the firearm, the outer sleeve further having a pair of longitudinally extending slots dividing the second end of the sleeve into a first section and a second section which are expandable in a first, transverse direction;

b) an inner rod having a first end configured and dimensioned to be at least partially insertable within the firing chamber and a second end configured and dimensioned to be at least partially insertable within the cavity of the outer sleeve;

c) a spring configured and dimensioned to be at least partially insertable within the cavity of the outer sleeve, between the second end of the inner rod and the outer sleeve, so as to bias the inner rod in an outward direction;

d) an expansion member having a wedge-shaped head portion configured and dimensioned to be received within the tapered opening in the second end of the sleeve and having an aperture formed therein, and wherein insertion of the expansion member within the opening in the sleeve expands the first and second sections of the sleeve in the first direction until the sleeve frictionally engages an inner surface of the barrel so as to secure the locking member therein such that the firearm cannot be loaded or fired; and a locking key including a handle portion, a shaft extending from the handle, and a base including a specially keyed member configured and arranged to be inserted into the corresponding aperture in the expansion member in order to turn the same; and wherein the length of the locking member can be adjusted by moving the rod and sleeve relative to each other against the biasing force of the sprina such that the length of the locking member can be adjusted and locked at different lengths so as to fit into the barrel and firing chamber of different type firearms, and wherein the safety device does not extend from within the firearm so as to be resistant to tampering.

19. The safety device of claim 18, further comprising an engagement member configured and arranged to engage the sleeve so as to grip the sleeve and prevent rotation thereof as the expansion member is inserted into the opening in the second end of the sleeve.

20. The safety device of claim 19, wherein the engagement member includes a first leg and a second leg configured and dimensioned to fit within the first and second elongated slots, the first and second legs being connected by a bridge having an opening disposed therein for receipt of the shaft of the key therethrough.

* * * * *